US007357584B2

(12) United States Patent
Suzuki et al.

(10) Patent No.: US 7,357,584 B2
(45) Date of Patent: Apr. 15, 2008

(54) SHEET TRANSPORT DEVICE

(75) Inventors: Tomoo Suzuki, Hachioji (JP); Susumu Okui, Hachioji (JP); Kazuyoshi Kimura, Hachioji (JP); Hideo Isohara, Hachioji (JP); Masakazu Nakamura, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 140 days.

(21) Appl. No.: 10/951,981

(22) Filed: Sep. 28, 2004

(65) Prior Publication Data

US 2005/0196210 A1 Sep. 8, 2005

(30) Foreign Application Priority Data

Mar. 2, 2004 (JP) ..... 2004-056952

(51) Int. Cl.

| | |
|---|---|
| ***G03G 15/00*** | (2006.01) |
| ***B65H 9/14*** | (2006.01) |
| ***B41J 11/24*** | (2006.01) |
| ***B41J 13/00*** | (2006.01) |

(52) U.S. Cl. ..... 400/578; 399/361; 399/372; 399/394; 271/226

(58) Field of Classification Search ..... 399/388, 399/394

See application file for complete search history.

(56) References Cited

U.S. PATENT DOCUMENTS

| | | | | |
|---|---|---|---|---|
| 5,240,241 | A * | 8/1993 | Kawazoe | 271/114 |
| 5,564,956 | A * | 10/1996 | McDavid | 440/6 |
| 2003/0113150 | A1* | 6/2003 | Fujita | 399/394 |
| 2004/0005169 | A1* | 1/2004 | Yokomori et al. | 399/117 |

FOREIGN PATENT DOCUMENTS

| | | | |
|---|---|---|---|
| JP | 05097292 | A * | 4/1993 |
| JP | 05338865 | A * | 12/1993 |
| JP | 07267434 | A * | 10/1995 |
| JP | 11-138929 | * | 5/1999 |
| JP | 11268850 | A * | 10/1999 |
| JP | 2002-265097 | | 9/2002 |
| JP | 2004026353 | A * | 1/2004 |

* cited by examiner

*Primary Examiner*—Daniel J. Colilla
*Assistant Examiner*—Nguyen Q. Ha
(74) *Attorney, Agent, or Firm*—Cantor Colburn LLP

(57) ABSTRACT

Disclosed is a sheet transport device having: a registration roller to transport a sheet after correcting a skew of the sheet; a drive source to drive the registration roller; a frame body; and a rotation resisting body which is connected to the registration roller on one side and is connected to the frame body on the other side, to create a resisting force against a rotation of the registration roller in a sheet transport direction.

8 Claims, 7 Drawing Sheets

SHEET TRANSPORT DEVICE

BACKGROUND OF THE INVENTION

1. Field of the Invention

The present invention relates to a recording medium transport device comprising a transmission mechanism such as a gear mechanism, a belt transmission mechanism, a chain transmission mechanism or the like between a drive source and a registration roller.

2. Description of the Related Art

So far, a sheet transport devices such as a document transport mechanism and a print paper transport mechanism of an image forming apparatus has been widely known. The image forming apparatus, for example an electrophotographic type image forming apparatus, comprises an image bearing body, an image writing part, a developing device, a sheet feeding cassette, a transferring part, a fixing device or the like. The image writing part forms an electrostatic latent image onto the bearing body that is uniformly electrically charged, and the developing part develops the latent image to a toner image. One transfer sheet as a print paper is transported from the sheet feeding cassette, and the toner image formed on the image bearing body is transferred to the transfer sheet at the transferring part. Then, the transfer sheet is transported to the fixing device, and the toner image is fixed to the transfer sheet. The transport mechanism comprises registration rollers (timing rollers) for guiding the transfer sheet to the transferring part at a predetermined timing. The transfer sheet contacts a nip portion of the registration rollers for skew correction, enabling to perform image formation in the correct position and direction.

Drive force is transmitted from the drive source such as a drive motor or the like to one of the registration rollers through a plurality of gears, and there is a clearance (looseness) so called backlash exists at a meshing portion of gears or an engaging portion of a gear and a shaft of the registration roller.

After transferring the transfer sheet to the image forming part, the registration rollers are stopped for making the tip portion of the next transfer sheet contact the registration rollers, however, the registration rollers rotate by the amount of the backlash with the moment of inertia of the registration rollers themselves at this time. In the case that the registration rollers are stopped at a position which is ahead by the amount of the backlash, when the drive source starts to drive the registration roller again, the gears or the like spin out by the amount which the registration rollers lead before the drive force is transmitted to the registration rollers. Thus, there is a time difference generated between the time when the drive source starts to drive and the time the registration rollers actually starts to drive.

If the amount which the registration rollers lead before the drive force is transmitted to the registration rollers is constant, there would be no problem. However, practically, the registration rollers stop at a different position every time, so that the amount which the registration rollers lead is not always constant. As described above, when the amount which the registration rollers lead is not constant, it would cause variation of the timing to carry a transfer sheet, therefore, a toner image may be transferred to the transfer sheet at a position where the toner image is misaligned in the transport direction.

The variation of the timing to transport a transfer sheet would be caused when handling jamming which happened near the registration rollers as well as when driving and stopping the registration rollers as described above. When jamming happens, the jammed transfer sheet needs to be removed by opening a door of the image forming apparatus. At this time, a user or a service man may rotate the registration rollers in a direction opposite to the transport direction of the transfer sheet, which would cause a gap in the timing to transport a transfer sheet.

There is known an image forming apparatus disclosed in Japanese Unexamined Patent Publication Tokkai-2002-265097A which can prevent displacement of a toner image transferred onto the transfer sheet. In such image forming apparatus, a transfer sheet contacts a specific contact surface which is provided closer to an image forming part than the registration roller. The contact surface can be evacuated from a transport path by a solenoid.

However, the technique in the above described Tokkai-2002-265097A uses the specific contact surface for contacting a transfer sheet, and the solenoid for disposing or evacuating the contact surface at or from the transport path. This would result in increasing the number of components and making the control complicated, thereby raising the cost for manufacturing an image forming apparatus.

A gap in timing to transport a sheet is a problem even in an image forming apparatus which does not require transferring such as an ink jet type image forming apparatus, or in a document transport apparatus such as an ADF, so that it is desired to transport sheets at correct timing without raising the cost for manufacturing an apparatus.

As a transmission mechanism between the drive source and the registration roller, a belt transmission mechanism, a chain transmission mechanism or the like has been known other than a gear, however, these mechanisms would also cause a phenomenon similar to the backlash. That is, there is looseness in a belt which is wound on a pair of pulleys or in a chain wound on a pair of sprockets, and that looseness would cause a phenomenon similar to the backlash. Accordingly, even when the belt transmission mechanism or the chain transmission mechanism is used as a transmission mechanism between the drive source and the registration roller, an idea for realizing to transport sheets at a correct timing at low cost is desired.

SUMMARY OF THE INVENTION

An object of the present invention is to provide a recording medium carrying device which can prevent variation of timing to carry a recording medium at a registration roller without increasing the cost.

For accomplishing the problems, in accordance with one aspect of the present invention, a sheet transport device comprises:

- a registration roller to transport a sheet after correcting a skew of the sheet;
- a drive source to drive the registration roller;
- a frame body; and
- a rotation resisting body which is connected to the registration roller on one side and is connected to the frame body on the other side, to create a resisting force against a rotation of the registration roller in a sheet transport direction.

The rotation resisting body may be connected to the frame body through an elastic member for reversing the registration roller.

In accordance with another aspect of the present invention, the sheet transport device comprises:

- a registration roller to transport a sheet after correcting a skew of the sheet; and a control unit to make the registration roller spin out in a direction same as a rotation direction of the registration roller when transporting the sheet, before the sheet reaches the registration roller.

The control unit may make the registration roller spin out after handling a jamming or switching on a power supply.

The sheet transport device may further comprise:

a frame body; and a rotation resisting body which is connected to the registration roller on one side and is connected to the frame body on the other side, to create a resisting force against a rotation of the registration roller in a sheet transport direction.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 4A shows a state where a drive motor is driven, and FIG. 4B shows a state where the drive motor was just stopped;

DETAILED DESCRIPTION OF THE PREFERRED EMBODIMENTS

The embodiments of the present invention will be explained below referring to FIGS. 1 to 7 below. Incidentally, the description in this column does not limit the scope and the meaning of terminologies of claims. Moreover, the affirmative descriptions in the following embodiments of the present invention indicate the best mode, and the descriptions do not limit the meaning of terminologies and the scope of the present invention.

Figure 1:
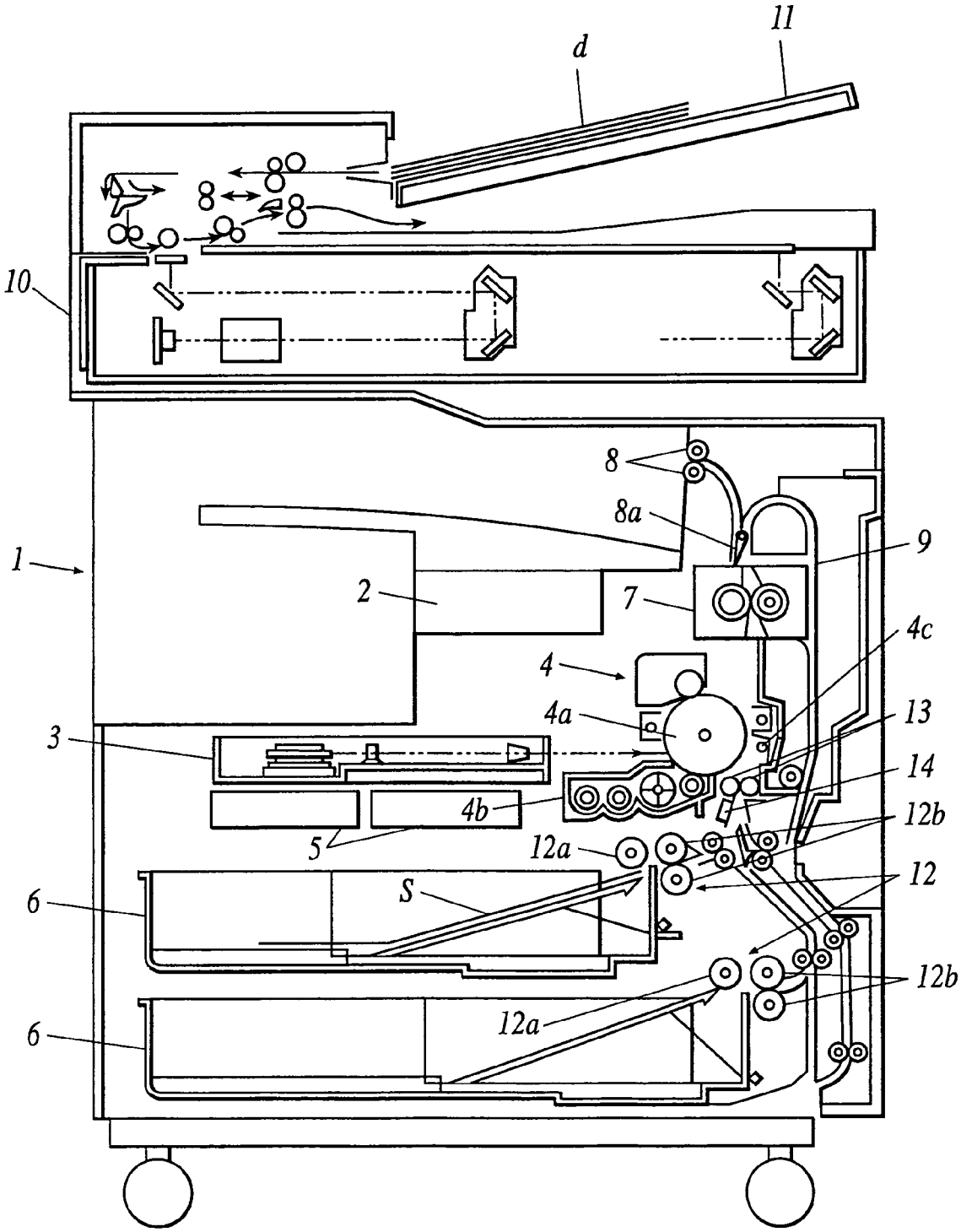
FIG. 1 is a sectional view of an image forming apparatus to which a sheet transport device according to the present invention is applied.

Next, embodiments of the present invention will be explained referring to the drawings. FIG. 1 shows a cross-sectional view of the image forming apparatus to which a sheet transport device according to the present invention is applied. The image forming apparatus 1 comprises an image processing part 2, an image writing part 3, an image forming part 4, a high voltage power source part 5, a sheet feeding cassette 6, a fixing part 7, sheet discharge rollers 8 and a re-transport part 9 for copying both sides of a sheet. The image forming apparatus 1 is provided with a document reading device 10 and a document transport device 11 at the upper portion thereof.

A document d put on the document carrying device 11 is transported in a direction shown by an arrow, and an image on one or both sides of the document d is read as an analogue signal by an optical system of the document reading device 10. The read analogue signal is subjected to analogue process, A/D conversion, shading correction, image compression process or the like. Then, the document d is sent to the image writing part 3.

The image writing part 3 forms an electrostatic latent image on an image bearing body 4*a* based on the image data sent from the image processing part 2. That is, the uniformly electrically charged image bearing body 4*a* is irradiated with the output light from a semiconductor laser provided on the image writing part 3. The formed electrostatic latent image is developed at the developing device 4*b* to become a toner image. The toner image is transferred to a transfer sheet S as a sheet transported from one of the sheet feeding cassettes 6 at the transferring part 4*c*, which is fixed to the transfer sheet S by the fixing device 7. In the case of copying both sides of the sheet, the transfer sheet S is transported to the re-transport part 9 by a transport path switching plate 8*a* to reverse the front and back sides of the transfer sheet S. Then, the transfer sheet S is transported to the image forming part 4 again. After forming an image, the transfer sheet S is discharged outside the image forming apparatus 1 by the sheet discharge rollers 8.

The sheet feeding device comprises the sheet feeding cassettes 6 and a sheet feeding part 12 for picking up one transfer sheet S to transport it to the image forming part 4. The sheet feeding part 12 comprises a pick up roller 12*a* and sheet feeding rollers 12*b*. The pick up roller 12*a* picks up the top transfer sheet S from one of the sheet feeding cassettes 6, and this transfer sheet S is carried to the image forming part 4 by the sheet feeding rollers 12*b*. The registration rollers 13 for truing up the direction of the transfer sheet S is provided in front of the image forming part 4, and a sensor 14 for detecting the transfer sheet S is provided in front of the registration rollers 13.

Figure 2:
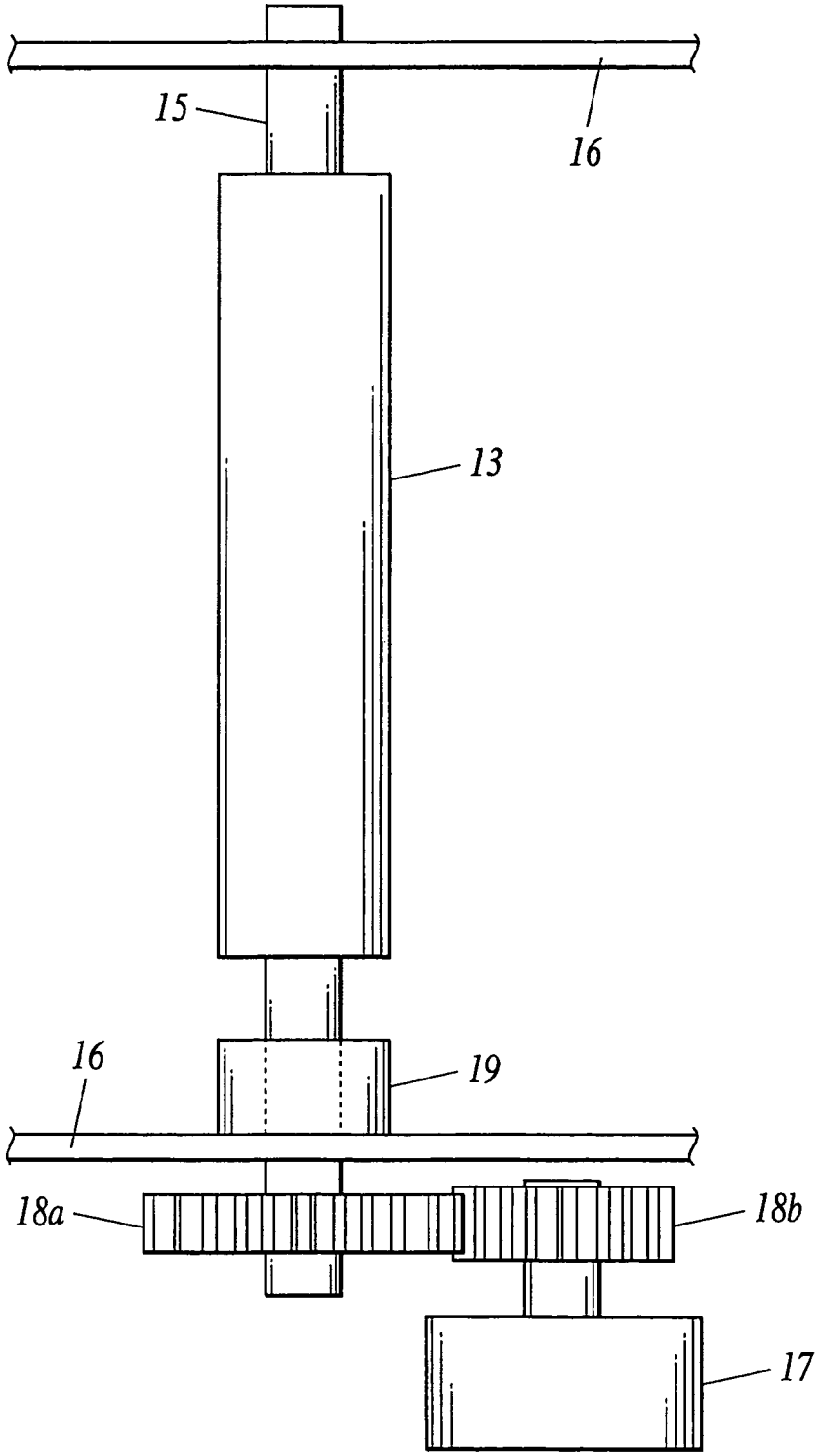
FIG. 2 is a view showing a structure of a registration roller of the first embodiment.

FIG. 2 is a view showing a structure of the registration roller of the first embodiment. The registration roller 13 is formed in a cylindrical shape, and a shaft 15 is inserted through the central portion of the registration roller 13. The shaft 15 is rotatably attached to frames 16 provided on both sides of the transport path, and is provided with a gear 18*a* at one side for transmitting drive force from a drive motor 17 which is a drive source. The gear 18*a* is engaged with a gear 18*b* provided at the drive motor 17 to transmit the drive force to the registration roller 13. In FIG. 2, the gear 18*a* is directly engaged with the gear 18*b*, however, a plurality of gears may be provided between the two gears 18*a* and 18*b*.

The shaft 15 is provided with a rotation resisting body 19 which is fixed to one of the frames 16. The rotation resisting body 19 is for creating resisting force against the rotation direction of the registration roller 13 while the registration roller 13 is driven. The resisting force is smaller than the drive force transmitted from the drive motor 17, but is larger than the moment of inertia of the shaft 15. Examples of such rotation resisting body 19 include a torque limiter or the like. In FIG. 2, a cylindrical shaped torque limiter is engaged with the shaft 15, and one end thereof is fixed to the frame 16.

Figure 3:
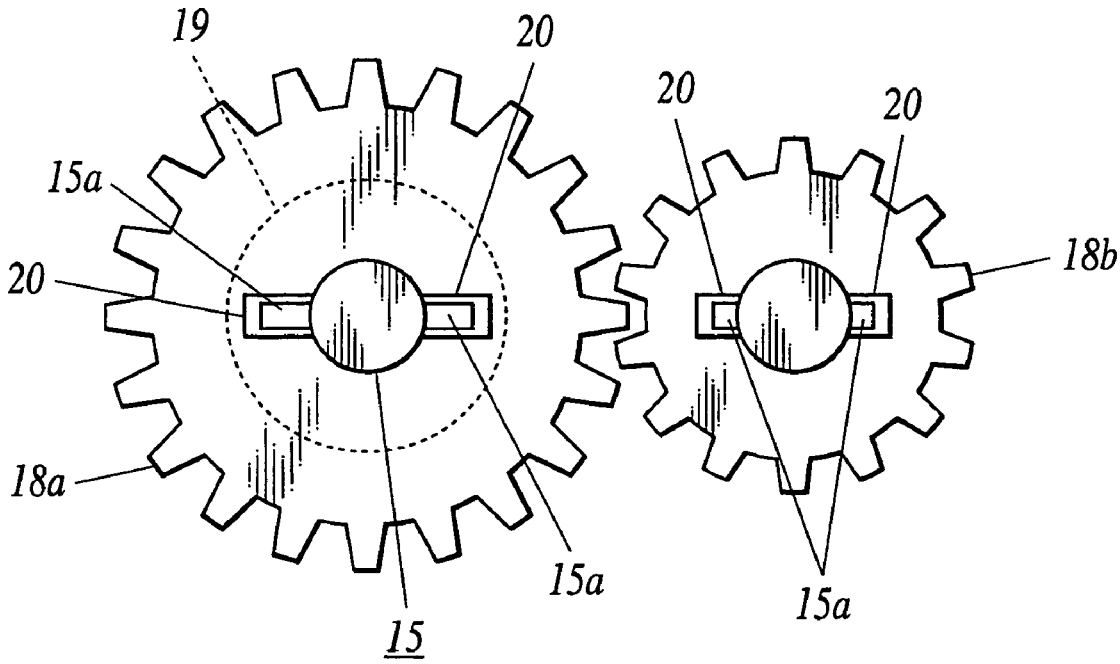
FIG. 3 is a view showing a condition where a gear is attached to a shaft.

FIG. 3 is a view showing a condition where a shaft is attached to a gear. The shaft 15 comprises a pin 15*a* for engaging with the gear 18*a*, and the gear 18*a* comprises a pin groove 20 for engaging the pin 15*a* therewith. Similarly, the pin 15*a* and the pin groove 20 are provided at an attaching portion of the gear 18*a* and the drive motor 17. At the engaging portion of the pin 15*a* and the pin groove 20, there is a slight looseness so called backlash. There is also backlash at the engaging portion of the gear 18*a* and the gear 18*b*. Therefore, there is a time lag generated from the time the drive motor 17 starts to rotate to the time the shaft 15 starts to rotate by the amount of the backlash. In this embodiment, the backlash is always on one side, so that the time lag from the time the drive motor 17 starts to rotate to the time the shaft 15 starts to rotate can be prevented.

Figure 4A:
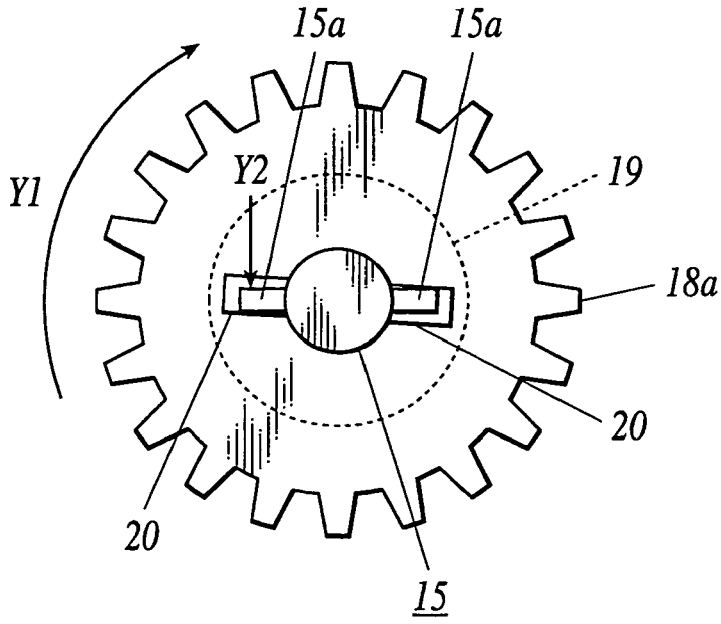
FIGS. 4A and 4B are views showing a principle of operation of the first embodiment.
Figure 4B:
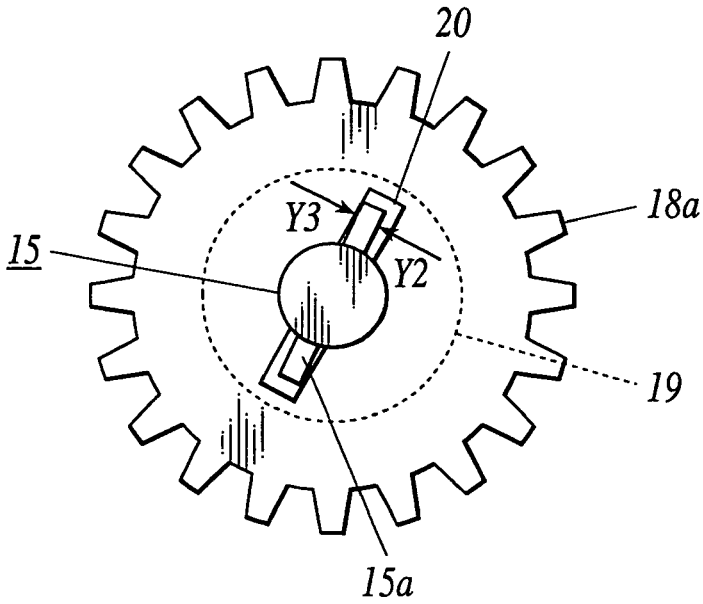

FIGS. 4A and 4B are views showing a principle of operation in the first embodiment. FIG. 4A shows a condition where the drive motor 17 is driven, and FIG. 4B shows a condition just after the drive motor 17 was stopped. When the drive motor 17 starts to drive, the gear 18*a* rotates in a clockwise direction as shown by an arrow Y1 in FIG. 4A. The pin 15*a* provided at the shaft 15 is biased to one side of the pin groove 20, and the pin 15*a* is pressed by the shaft 15, so that the shaft 15 rotates in the same direction of the gear 18*a*. At this time, resisting force acts on the shaft 15 by the rotation resisting body 19 in a direction as shown by an arrow Y2 which is opposite to the rotation direction. The resisting force is smaller than the drive force from the drive motor 17, so that no problem would occur when transporting the transfer sheet S.

After transporting the transfer sheet S to the image forming part 4, the drive motor 17 is stopped. At this time, the shaft 15 tends to continue to rotate in a direction shown by an arrow Y3 in FIG. 4B by the moment of inertia. However, since the resisting force which is larger than the moment of inertia is applied to the shaft 15 from the rotation resisting body 19 in a direction which is opposite to the moment of inertia, the shaft 15 stops its rotation together with the drive motor 17 at the same time. Thus, the pin 15*a* of the shaft 15 remains to contact one side of the pin groove 20 of the gear 18*a*. The engaging portion of the gears 18*a* and 18*b*, and the pin 15*a* and the pin groove 20*a* for connecting the gear 18*b* to the drive motor 17 stop in a condition where the backlash is on one side because the shaft 15 and the drive motor 17 stop at the same time.

When the drive motor 17 starts to drive again to carry the next transfer sheet S, the backlash between the pin 15*a* and the pin groove 20, or between the gears 18*a* and 18*b* remains in a condition just after the drive motor 17 was stopped, so that the shaft 15 starts to rotate at the time when the drive motor 17 starts to drive, and then the registration rollers 13 transport the transfer sheet S. Attachment of the rotation resisting body 19 is successful in eliminating the time difference between the time when the drive motor 17 starts to rotate and the time the registration rollers 13 start to rotate, enabling to always transport the transfer sheet S to the image forming part 4 at an appropriate timing.

Figure 5:
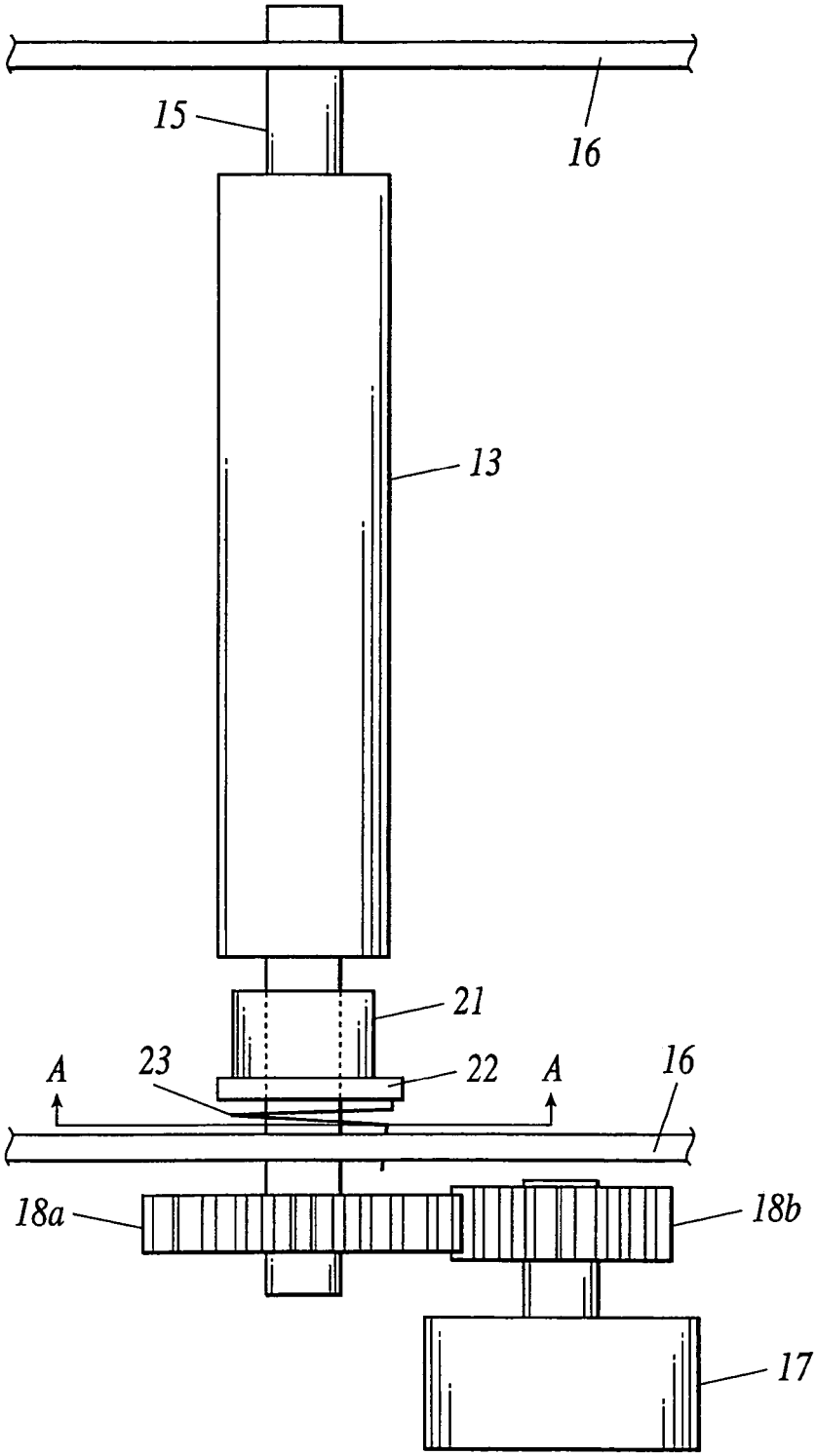
FIG. 5 is a view showing a structure of a registration roller of the second embodiment.

FIG. 5 is a view showing a structure of the registration roller of the second embodiment. The components that are same as in the first embodiment will be given the same reference numerals and the explanations thereof will be omitted. In the above described first embodiment, the rotation of the shaft 15 needs to be stopped at the time when the drive motor 17 is stopped, so that the rotation resisting body 19 which can generate high resistance needs to be used. However, while the drive motor 17 drives, this resistance would act as an unnecessary resistance force, so that it is desirable the resistance of the rotation resisting body 19 is as small as possible. In the second embodiment, the recording medium carrying device is improved on this point.

In the second embodiment, a rotation resisting body 21 such as a torque limiter or the like is attached to the shaft 15 of the registration roller 13 at the side of one of the frames 16. The rotation resisting body 21 comprises a sheet metal 22 and a coil spring 23 as an elastic member. The metal sheet 22 is attached to the rotation resisting body 21. The coil spring 23 is wound about one circle around the shaft 15, and one end thereof is fixed to the metal sheet 22 and the other end thereof is fixed to the frame 16.

Figure 6:
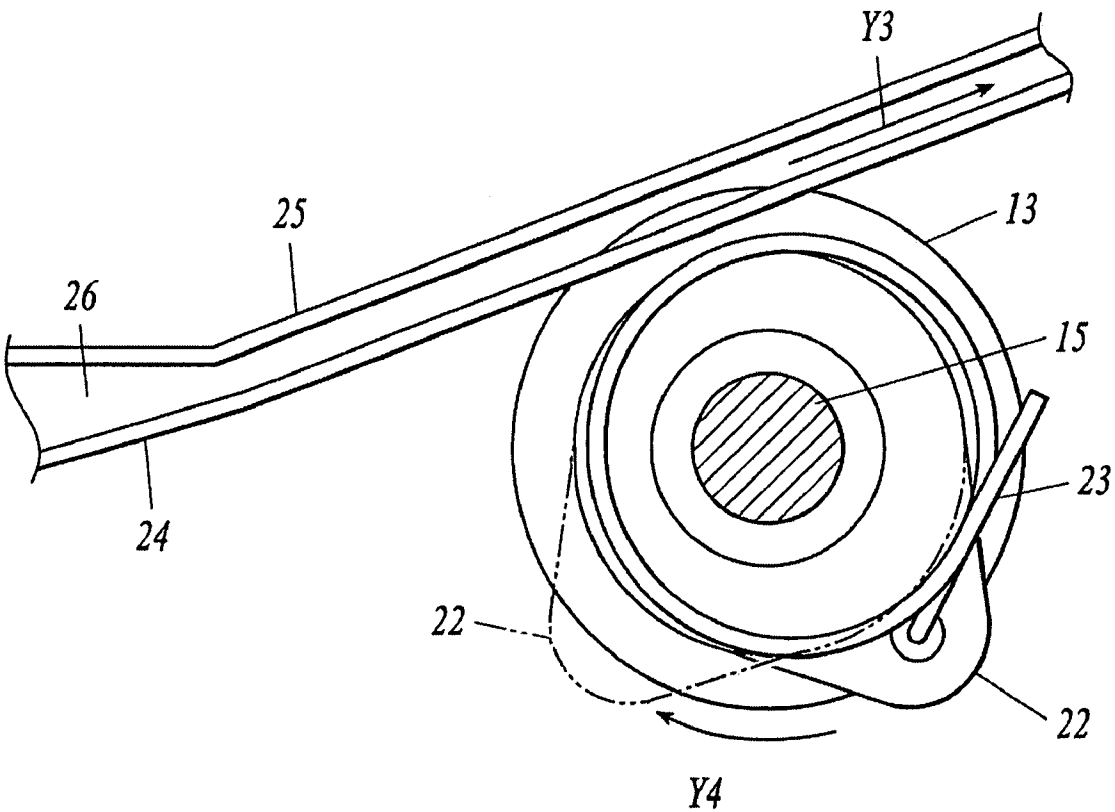
FIG. 6 is a sectional view taken along the line A-A in FIG. 5.

FIG. 6 is a sectional view taken along the line A-A in FIG. 5. There are provided guides 24 and 25 at the upper portion of the registration roller 13, and a transport path 26 of the transfer sheet S is formed between the guides 24 and 25. The transfer sheet S is transported in a direction shown by an arrow Y3, that is, from left to right in FIG. 6. A driven roller of the registration rollers (not shown in this figure) is provided to nip with driving roller of the registration rollers 13.

The metal sheet 22 has a teardrop shape, that is, a part of the circle projects. On end of the coil spring is fixed to the projecting portion. The registration roller 13 rotates in a direction shown by an arrow Y4 in FIG. 6 with the drive force from the drive motor 17. The rotation resisting body 21 is not fixed to the frame 16 as the rotation resisting body 19 in FIG. 2, so that it rotates together with the shaft 15. The metal sheet 22 also rotates together with the rotation resisting body 21 at the same time, and the coil spring 23 is twisted with this rotation. When the torsion torque of the coil spring 23 is equal to the resisting force of the rotation resisting body 21, the rotation resisting body 21 starts to slip, and the rotation of the metal sheet 22 and the rotation resisting body 21 is stopped.

When the transfer sheet S is transported and the drive motor 17 is stopped, the shaft 15 tends to continue to rotate in the direction of the arrow Y4 by the moment of inertia. However, since the coil spring 23 tries to rotate the shaft 15 in the opposite direction, the positional relation of the pin 15*a* and the pin groove 20 is as shown in FIG. 4B, that is, the pin 15*a* is biased to one side of the pin groove 20. Even when the moment of inertia of the shaft 15 is larger than the force of the rotation resisting body 21 to rotate the shaft 15 in the opposite direction, that is, even when the resistance of the rotation resisting body 21 is small, because the coil spring 23 rotates the shaft 15 in the opposite direction after only the shaft 15 rotates with the moment of inertia, the backlash is always biased to one side, therefore the timing to carry the transfer sheet S is kept constant.

In the second embodiment, the coil spring 23 is used as an elastic member, however, rubber or the like can be used instead of the coil spring 23.

In the above described second embodiment, a torque limiter is used as the rotation resisting body 21. The combination of the rotation resisting body 21 with the coil spring 23 is successful in biasing the backlash to a predetermined direction despite the low resistance of the rotation resisting body 21. In this combination, an electromagnetic brake may be used as the rotation resisting body 21 instead of a torque limiter. This can realize a structure in which no resistance is generated while the drive motor 17 is driven. That is, the electromagnetic brake is controlled such that the electromagnetic brake is not actuated while the drive motor 17 is driven, and is actuated at the time when the drive motor 17 is stopped. As the electromagnetic brake, for example, the micro electromagnetic brake manufactured by ASA ELECTRONICS INDUSTRY CO., LTD (Tokyo, JAPAN).

Figure 7:
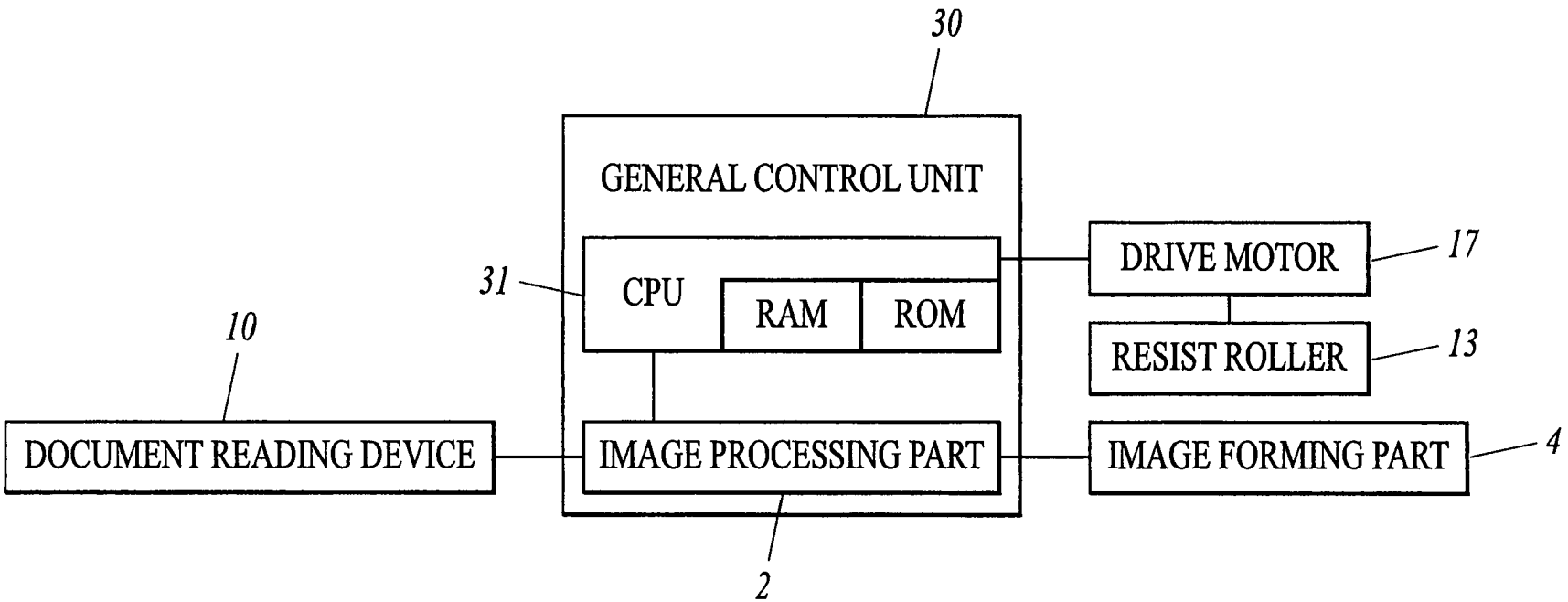
FIG. 7 is a block diagram of the image forming apparatus.

As a method to biasing the backlash to one side, a control unit to control the drive motor 17 for making the backlash be on one side may be used other than the above described rotation resisting bodies 19 and 21. FIG. 7 is a block diagram of an image forming apparatus to which the sheet transport device according to the present invention is applied. A general control unit 30 comprises a CPU 31 having a RAM and a ROM, and control the devices of the image forming apparatus 1 to actuate in cooperation with one another. The CPU 31 executes programs stored in the ROM with the RAM as a workspace to rotate the registration rollers 13 when the registration rollers 13 are in a stopped state, that is, when the registration rollers 13 are not transporting the transfer sheet 31, thereby realizing the control to make the backlash be on one side. The rotation resisting body 19 or 21 is not attached to the registration rollers 13 in FIG. 7.

The control procedures are as follows. The CPU 31 starts execution when the registration rollers 13 are stopped (when a sheet feeding operation is not performed) such as when the image forming process is finished or the like. The shaft 15 of the driving roller of the registration rollers 13 is stopped at a position which is ahead by the amount of the backlash by the moment of inertia.

The CPU 31 stops the drive motor 17 after driving it by the amount which the shaft 15 leads. At this time, the drive motor 17 is slowly rotated not to have a large moment of inertia, so that the positional relationship between the pin 15*a* and the pin groove 20 after the drive motor 17 is stopped becomes the state shown in FIG. 4B, that is, the pin 15 is biased to one side of the pin groove 20.

Use of the rotation resisting body 19 or 21, or the control unit such as the CPU 31 or the like is successful in making the backlash in normal image formation be on one side, thereby keeping the timing to carry the transfer sheet S constant. However, when jamming happens near the registration rollers 13, a user or a serviceperson may need to rotate the registration roller 13 in the opposite direction for removing the jammed transfer sheet S. In this case, the backlash is biased to the opposite side, so that there is a problem to cause variation of timing to carry the transfer sheet S. This problem would occur only to the first transfer sheet S to be transported after handling jamming. Thereafter, the pin 15*a* is biased to the one side of the pin channel 20 by the rotation resisting body 19 or 21.

To solve this problem, a user or a serviceperson controls the CPU 31 after handling jamming to return the backlash to its former state. Specifically, when the front or side door of the image forming apparatus 1 which was opened to remove the jammed transfer sheet S is closed, control of making the drive motor 17 spin out is performed by the CPU 31, and the CPU 31 stops the drive motor 17 after driving the drive motor 17 by the amount which the shaft 15 leads.

In the case of the registration roller 13 in which the rotation resisting body 19 or 21 is attached to the shaft 15, when the CPU 31 drives the drive motor 17 at a normal revolution for a predetermined time, the positional relationship of the pin 15*a* and the pin groove 20 becomes the state as shown in FIG. 4B with the use of the rotation resisting body 19 or 21.

In the above described embodiments, explanation was made to an example in which the present invention is applied to a transfer sheet transport device in an electrophotographic type image forming apparatus, however, the sheet transport device is not limited thereto. The sheet transport device may be applied to a print sheet transport device in an image forming apparatus which does not need transferring process such as an ink jet recording apparatus or a document transport device such as an ADF.

The entire disclosure of Japanese Patent Application No. Tokugan 2004-056952 which was filed on Mar. 2, 2004, including specification, claims, drawings and summary are incorporated herein by reference in its entirety.

What is claimed is:

1. A sheet transport device comprising:

a registration roller to transport a sheet after correcting a skew of the sheet;

a drive source to drive the registration roller through a gear; and a control unit to make the registration roller in a stop state rotate once in a direction same as a rotation direction of the registration roller when transporting the sheet, before the sheet reaches the registration roller, so as to make looseness between the gear and the registration roller be on one side in normal image formation.

2. The sheet transport device of claim 1, wherein the control unit makes the registration roller in a stop state rotate at once after handling a jamming or switching on a power supply.

3. The sheet transport device of claim 1, wherein a coil spring is provided so as to be wound around a shaft of the registration roller.

4. An image forming apparatus comprising:

a sheet transport device as claimed in claim 1; and a part where an image is formed on the sheet, the part being located a downstream side of the sheet transport device.

5. The image forming apparatus as claimed in claim 4, wherein the part comprises an image transferring part where the image is formed on the sheet by transferring the image onto the sheet.

6. An image forming apparatus comprising:

a sheet transport device as claimed in claim 1; and a part where an image is formed on the sheet, the part being located a down streamside of the sheet transport device.

7. The sheet transport device of claim 1, wherein the registration roller has a gear having a pin groove and a shaft having a pin engaging the pin groove, and an engaging portion of the pin and the pin groove has looseness.

8. The sheet transport device of claim 1, wherein the registration roller has a gear having a pin groove and a shaft having a pin engaging the pin groove, and an engaging portion of the pin and the pin groove has looseness.

* * * * *